United States Patent [19]

Kang

[11] Patent Number: 4,948,947

[45] Date of Patent: Aug. 14, 1990

[54] STEAM BOILER

[75] Inventor: Shin-Duk Kang, Hacienda Heights, Calif.

[73] Assignee: Pacific Steam Equipment, Inc., Los Angeles, Calif.

[21] Appl. No.: 224,169

[22] Filed: Jul. 26, 1988

[51] Int. Cl.[5] ..... H05B 3/02; F22B 1/28; B65D 6/02

[52] U.S. Cl. ..... 219/272; 220/5 A; 220/DIG. 25

[58] Field of Search ..... 220/5 A, DIG. 25; 219/271, 272, 273, 274, 275, 276, 362

[56] References Cited

U.S. PATENT DOCUMENTS

| | | | |
|---|---|---|---|
| 1,029,745 | 6/1912 | Eaton | 220/5 A |
| 2,126,997 | 8/1938 | Kramer | 220/5 A |
| 2,316,907 | 4/1943 | Wallace | 219/273 |
| 2,427,016 | 9/1947 | Miller | 219/273 |
| 2,731,167 | 1/1956 | Moore | 220/DIG. 25 |
| 3,398,261 | 8/1968 | Mays | 219/272 |
| 3,410,120 | 11/1968 | Schloss | 219/275 |
| 3,436,852 | 4/1969 | Stansbury | 219/373 |
| 3,508,354 | 4/1970 | Stansbury et al. | 219/273 |
| 3,823,497 | 7/1974 | Solomon | 219/272 |
| 4,002,287 | 1/1977 | Saveth | 220/DIG. 25 |
| 4,052,587 | 10/1977 | Eaton | 219/273 |
| 4,394,561 | 7/1983 | Zerbel | 219/275 |
| 4,414,037 | 11/1983 | Freidheim | 219/273 |

FOREIGN PATENT DOCUMENTS

| | | | |
|---|---|---|---|
| 2561629 | 9/1985 | France | 220/5 A |

*Primary Examiner*—A. D. Pellinen
*Assistant Examiner*—Geoffrey S. Evans
*Attorney, Agent, or Firm*—Harlan P. Huebner

[57] ABSTRACT

A relatively small portable steam boiler and steam iron system particularly suited for small commercial operations wherein the boiler is formed of two interlocking U shaped sections wherein there is created a water and steam chamber therein together with valves and gauges thereon and a steam iron attached to said boiler. The total electrical wattage to operate said boiler and steam iron does not excess 2000 watts and the electrical energy may be furnished from a single 120 volt electrical receptacle.

5 Claims, 2 Drawing Sheets

STEAM BOILER

BACKGROUND OF THE INVENTION

1. Field of the Invention

This invention relates to a relatively small commercial type portable steam boiler and single commercial type steam iron system.

2. Description of the Prior Art

In the garment industry there is need for commercial type of steam irons. To that end relatively large boilers are available that turn water to steam that include steam outlets to from three to four steam irons to press garment. While applicant has no knowledge of any patents on such boilers he is knowledgeable of Models PSE-3 and PSE-4 iron boilers manufactured and sold by Pacific Steam Equipment, Inc., Los Angeles, Calif., assignee of the invention, this application and any patent that may issue thereon.

The disadvantage of such large units as the PSE-3 and PSE-4 is that they are large and consume a great deal of space. In addition, the boiler capacity is that to accommodate three or four steam irons and operates on a 240 voltage electrical line. The boiler cannot satisfactorily be used for just a single steam iron and if it could, the operation would be costly compared to the value.

In addition, there have been attempts to make smaller type of portable steam boilers for curtailed use, such as with one steam iron. However, the disadvantage of such steam boilers has been that due to the watts necessary to operate the boiler as well as the watts necessary for operating the heating element of the steam iron two 120 volt electrical outlets have been required, that is one for the boiler and one for the steam iron. In other attempts to create small steam boilers and steam iron combination systems both using high wattage and if a single electrical outlet was used a switch was required to only activate one or the other but not both at the same time.

SUMMARY OF THE INVENTION

It is a purpose of the present invention to provide a steam boiler that is light weight, portable and capable of supplying steam to a single steam iron for use in the garment industry, retail garment sales and dry cleaning establishments to iron garments.

Another object of the present invention is to provide a steam boiler and steam iron system that operates on 120 voltage with a combination of approximately 15 amps whereby a single electrical plug may be used to activate both the boiler and iron simultaneously.

A still further object of the present invention is to provide a relatively small steam boiler having varying controls including automatic water feeder and water level probes.

A yet further object of the present invention is to create a steam boiler that may be formed of two interconnecting U shaped body members having fittings to receive various items for registering water level, steam pressure and other functions.

These and other objects and advantages will become apparent from the following part of the specification wherein details have been described for the competence of disclosure, without intending to limit the scope of the invention which is set forth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 1:
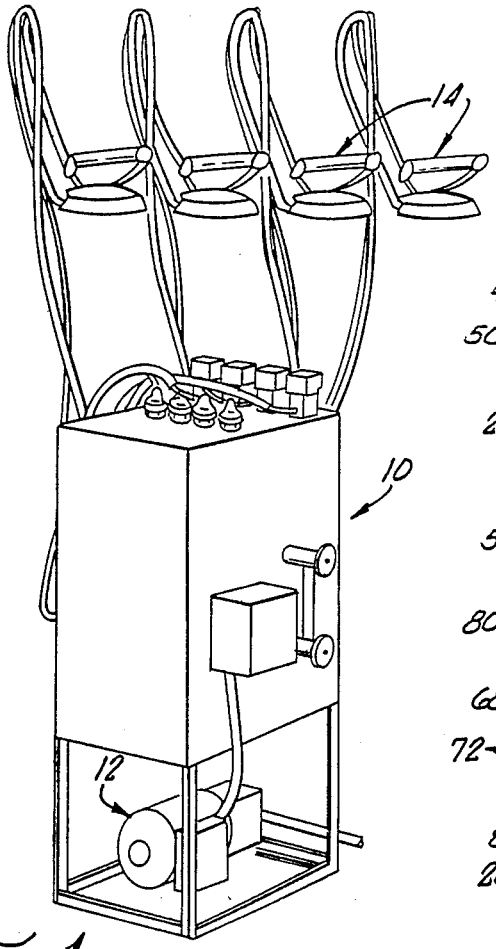
FIG. 1. PRIOR ART
FIG. 1 is an illustration of the relatively large four iron steam boiler presently on the market.

In FIG. 1 there is illustrated a relatively large steam boiler 10 which for all intent and purpose is a permanent fixture that weighs on the order of 148 lbs. Generally, the motor 12 requires 240 voltage and the boiler 10 will produce steam up to 100 p.s.i. In addition, attached to the large boiler 10 are from three to four conventional steam irons 14.

The unit of FIG. 1 is considered a commercial boiler 10 adopted for use in the garment industry where many steam irons are needed to press off goods.

Figure 6:
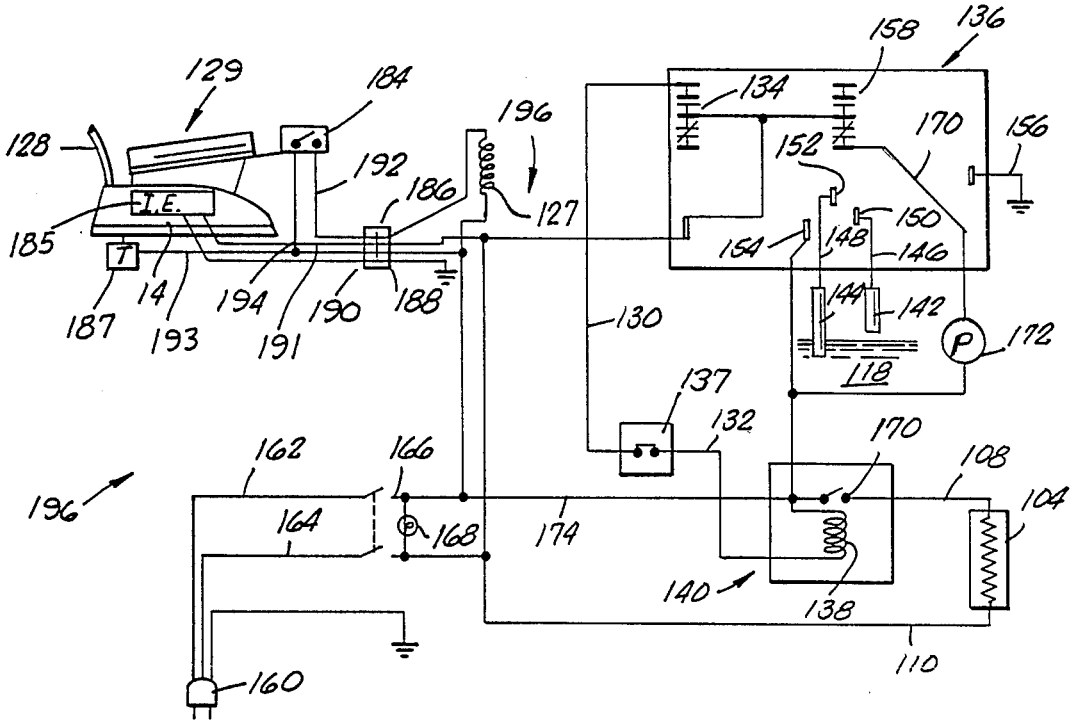
FIG. 6 is a schematic wiring diagram of the present invention.

The present invention resides in the relatively small portable steam boiler 20 in combination with a single conventional steam iron 14, see schematic of FIG. 6.

Figure 3:
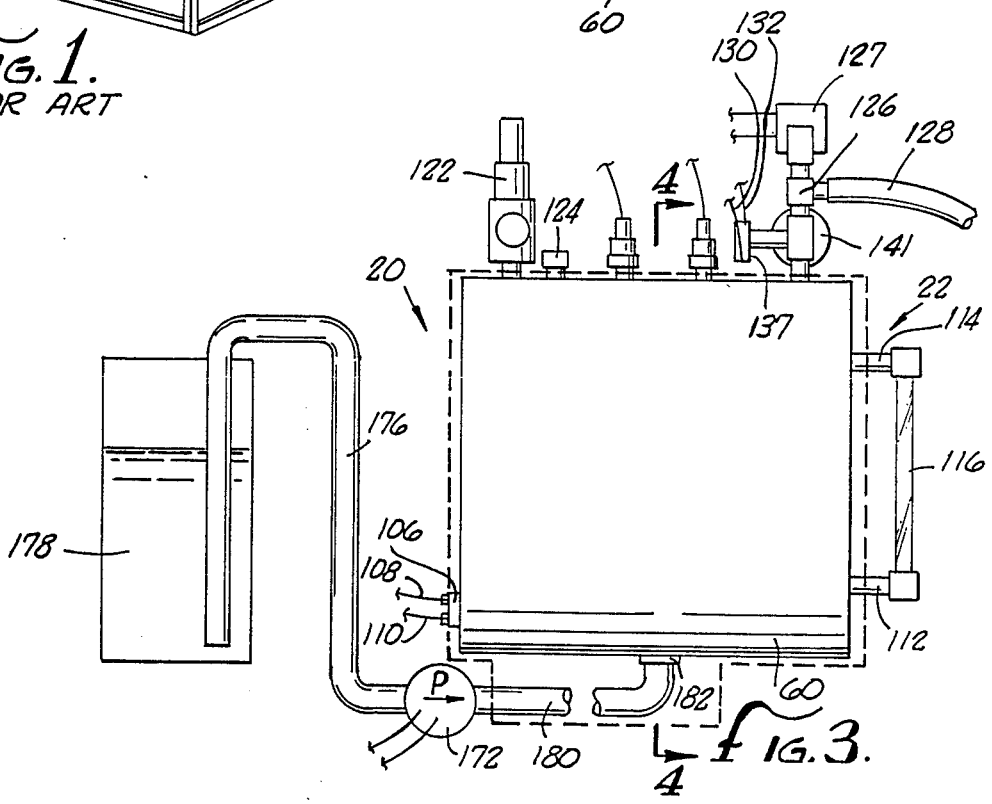
FIG. 3 is a side elevational view of the new boiler of the present invention connected to a source of water for making steam in said boiler.
Figure 4:
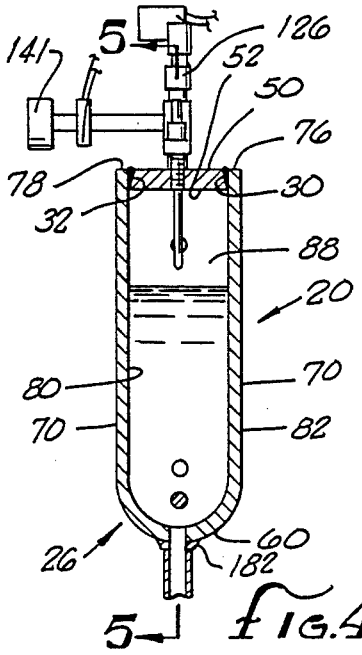
FIG. 4 is an end sectional view of the new boiler taken lines 4—4 of FIG. 3.

The boiler 20 is to be fitted with an exterior housing 22, illustrated in dashed lies in FIG. 3, of any conventional style. Such a cover or housing is adapted to insulate the boiler 20 and to include means to mount the boiler 20 therein. Preferably such a housing has ventilation vents and contains the electrical elements to be discussed.

Figure 2:
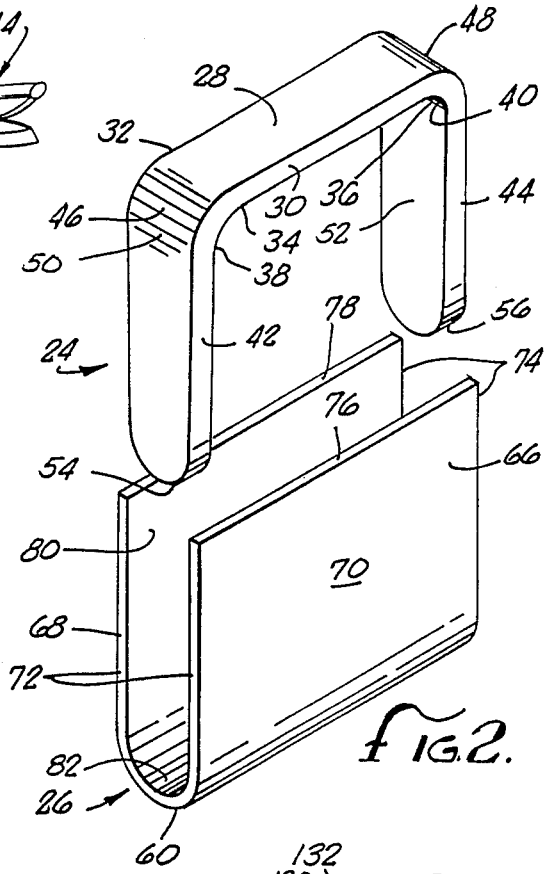
FIG. 2 is an exploded view of the preferred two piece structure used in forming a steam boiler of the present invention.

The boiler 20 is best illustrated in FIG. 2, and it preferably includes only two generally U shaped metal members designated 24 and 26 one of which is interfitted within the other.

The top U shaped metal member 24 includes a top At the respective outer ends 34 and 36 of the bridge member 24 the member 24 is bent at right angles 38 and 40 forming parallel legs 42 and 44.

At the right angles 38 and 40 the bends 46 and 48 on the exterior surface 50 of the member 24 are rounded, see FIG. 2.

There is also an interior surface 52 of the U shaped metal member 24. The ends 54 and 56 of the legs 42 and 44 are preferably rounded for reasons to be explained.

The bottom U shaped metal member 26, see FIG. 2, includes an elongated rounded, in cross section, bridge section with a curve complementary with the curved or rounded ends 54 and 56 of top U shaped member 24.

Extending upwardly from the curved bridge 26 are a pair of parallel wall legs 66 and 68.

The legs 66 and 68 include parallel walls 70 having end edges 72 and 74 and top edges 76 and 78 respectively. There is an interior surface 82 of the bottom U shaped section 26.

The space between the walls 70 of section 26 is complementary with the width of top U shaped metal member 24.

In order to assemble the boiler 20 there is a mating of the sections 24 and 26 and then the sections are welded along edges 72, 74 and 76 of the bottom U shaped member to make a tight leak proof boiler 20.

As best seen in FIG. 2, the thickness of the top and end shaped section 24 is greater than the thickness of the bottom U shaped mating section 26. The reason for the greater thickness of the top U shaped section 24 is because all of the instruments and other operating elements extend through that section.

The above described two U shaped sections are preferred because of the lack of a great deal of welding to unite the two parts. Also such structure design is better to withstand the elevated steam pressures that will build up in the boiler 20.

However, without departing from the spirit of the invention it is possible that the boiler 20 could be formed of separate sides, top, bottom and ends with the pieces welded together to form a boiler 20.

Before the sections 24 and 26 are secured together appropriate attachment openings are drilled to receive elements for the boiler 20.

Figure 5:
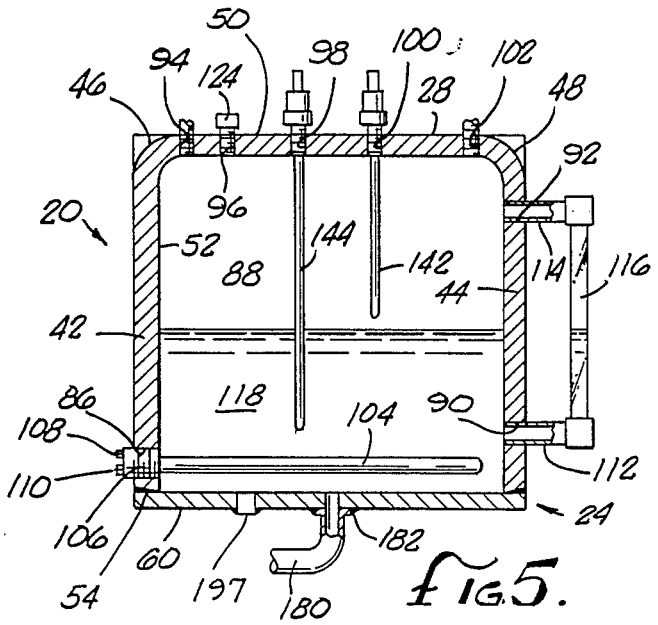
FIG. 5 is a side elevational sectional view of the new boiler taken on line 5—5 of FIG. 4.

As an illustration of attachment openings refer to FIG. 5. In leg 42 adjacent rounded end 54 a threaded heating element bore 86 passes through to the chamber 88. On the opposite leg 44 a pair of vertically aligned threaded water level guage bores 90 and 92 pass through the leg 44. On the flat bridge section 28 there are a number of threaded openings 94, 96, 98, 100 and 102 that pass through into chamber 88. Each of these will be explained. Additional bores may be provided depending upon what other monitoring devices or attachments are required.

Fitted into bore 86 is a conventional elongated resistance water heating element 104 that is attached to a threaded insert 106 mounted in bore 86. The insert 106 contains two electrical wires 108 and 110 that are best seen in the schematic of FIG. 6. The heater preferably operates on 1000 watts, which has been found sufficient to produce steam rapidly in the relative small boiler 20.

On the opposite leg 44 of U shaped member 24 mounted within bores 90 and 92 are threaded extension pipes 112 and 114. Extending between extension pipes 112 and 114 is a conventional glass water level guage 116. The purpose for the guage 116 is to visually discern the amount of water 118 within the chamber 88.

On the top bridge section 28 the opening 94 is adapted to receive a conventional safety or release valve 122 to release steam where the pressure exceeds a certain p.s.i.

Bore 96 is adapted to threadable receive a conventional check valve or vacuum breaker 124.

On the right hand side of the bridge 28, see FIG. 3 there is located a conventional steam solenoid valve body 126 to allow steam in the boiler 20 to pass out steam hose 128 to a steam iron generally designated 129 (see FIG. 6). Mounted on top of the steam solenoid valve body 126 is a solenoid valve coil 127 that interfaces with iron 129. A pressure control switch 137 is interposed between wires 130 and 132 which extend to a high voltage contactor 134 on a circuit board designated 136 and to coil 138 of contactor 140.

Also attached to the steam solenoid valve 126 is a visual steam guage 141.

While all of the valves are shown mounted on the top they can be mounted elsewhere on the U shaped member 24 without departing from the spirit of the invention.

Projecting into the chamber 88 of boiler 20 are a pair of water level probes 142 and 144. Probe 142 is referred to as the high probe and LLCO probe 144 is preferably referred to as low level cut-off probe. The probes are conventional and contain electrodes that register through respective wires 146 and 148 with controls such as schematically illustrated at 150, 152 and 154 on the circuit board 136, see FIG. 6. The circuit board 136 also includes a ground 156 and another water control contacter 158.

In operation, the boiler and iron system is plugged into ordinary single 120 voltage through plug 160. Electricity will flow through wires 162 and 164 and through a master switch 166 which may or may not be equipped with a pilot light 168. If the system is cold the switch 170 remains open until water is pumped into the boiler 20. The pumping takes place when the probe 142 has no water touching the electrode therein. The contactor 158 will be activated through wire 170 completing the circuit to a water pump 172 because electricity has moved through closed switch 166 along wire 174 to the pump 172. The pump 172 is connected by a pipe 176 to a water source 178. From the pump a delivery pipe 180 moves water 118 into the boiler 20 through a threaded fitting 182 in the rounded bottom bridge section 60.

When the water engages the high probe 142 the pump 172 is deactivated through the contactor 158.

With water in the boiler 20 the switch 170 is closed and the heater element 104 may be activated to heat the water 118 to usable steam in approximately 15 to 20 minutes. As steam develops it will pass out the steam solenoid valve body 126 through steam hose 128 to the iron 129. On the iron 129 is a thumb switch 184 to activate the conventional heating or iron element 185, shown as a box with "I.E." and thermostat 187 shown as a box with "T" therein through appropriate wires 191, 193 respectively in the iron 129. Preferably there is a mating iron plug generally designated 186. In actual practice a first half 188 may be mounted on the cover or housing 22 and the second half 190 carrying wires 192 and 194 plugged into the first half 188.

The other side of the circuit board 136 controls the steam pressure. As steam in generated by heating water 118 a conventional pressure control switch 137 which is normally closed can be opened as steam pressure engages a diaphragm (not shown) in the switch element. With increased pressure a point is reached, in the present size boiler of 50 p.s.i., when the diaphragm forces the micro switch 128 open which at that point will deactivate the coil 138 and open switch 170 so that the heater 104 may be turned off.

There is also preferably included a "blow down" opening and fitting 196, see FIG. 5 is the bottom of the boiler 20. This fitting may have a valve, not shown, attached thereto. At the end of the work shift or at selected times it is advisable and desirable to "blow down" the boiler 22 to rid it of particles and debris. To accomplish the "blow down" a valve (not shown) on the fitting 196 may be manually opened while there is still some steam remaining in the boiler 20. The steam will force out the water and flush the boiler.

It is also to be understood that the fitting 182 could also be utilized with a appropriate valve and T coupling to both allow the water 118 into the boiler and also act as a bypass to flush the boiler.

The general wattage of the iron 129 is approximately 800 watts and the boiler heater approximately 1000 watts. Thus, it can be seen that with a combined wattage of 1800 the boiler 20 and the iron 129 may both operate off of one 120 volt, 15 amp. receptacle. Thus, there is created a compact relatively light portable steam boiler-steam iron system generally designated 196. Such a system can be used efficiently by retail clothiers to press off garments as well as small dry cleaning establishments or any other individuals needing a single commercial type steam iron system.

From the stand point of acceptable water heating time to usable steam the internal dimension of the chamber 88 of the boiler 20 generally will range on the lower end from a chamber of approximately 66 cubic inches to the upper end of approximately 194 cubic inches. It has been found that a boiler 20 of approximately 165 cubic inches is preferable to produce steam for use in the steam iron 129 within approximately 15 to 20 minutes from the time the system is activated.

When the cubic inches of the boiler 20 are increased to within the higher rate as previously discussed it will usually also be necessary to increase a 120 voltage line from 15 amps to 20 amps in order to energize the heater 104 sufficiently to produce steam in the times set forth above.

The invention and its attendant advantages will be understood from the foregoing description and it will be apparent that various changes may be made in the form, construction and arrangements of the parts without departing from the spirit and scope thereof or sacrificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A metallic steam boiler for a steam boiler and steam iron system electrically operatable from one 120 volt electric power receptacle wherein said portable steam boiler includes gauge outlets, water inlet, steam outlet and a water heater and there is a steam hose from said steam outlet to said steam iron and electrical control means are associated with said boiler and said steam iron to activate said boiler, pass water thereinto, heat said water to steam and monitor steam pressure and the level of said water within said boiler, and to heat said steam iron through a thermostat, the improvement in said steam boiler including:

a first unitary generally U shaped member including a bridge portion forming a top of said boiler and a pair of spaced apart parallel leg members projecting therefrom having complementary parallel end edges and with said bridge forming a specific U shape, said leg members forming opposed end sections of said boiler and said bridge and leg members having a common width;

a second unitary generally U shaped member interfitted within said first generally U shaped member including an elongated bottom bridge portion and a pair of parallel spaced apart wall leg members forming the side walls of said boiler and projecting from said bottom bridge of a width complementary with the length of said elongated bridge portion of said first generally U shaped member and of a height generally corresponding to the length of said leg members of said first generally U shaped member and said bottom bridge and said wall leg members having cross sectional dimensions complementary with said specific shape of said first U shaped member to achieve said interfitting;

sealing means uniting said first and second U shaped members forming a water and steam tight chamber therein with communication between the atmosphere and said chamber through said outlets and said water inlet.

2. A metallic steam boiler and steam iron system as defined in claim 1 wherein:

said first generally U shaped member bridge and legs has a thickness greater than the thickness of said bridge and legs of said second generally U shaped member; and said outlets are positioned through said first generally U shaped member; and said inlet is positioned through said second generally U shaped member.

3. A metallic steam boiler and steam iron system as defined in claim 1 wherein:

a flush outlet is positioned through said second generally U shaped member.

4. A metallic steam boiler and steam iron system as defined in claim 1 wherein:

said sealing means includes metal groove welds where said first generally U shaped member and said second generally U shaped member are in contact with each other.

5. A metallic portable steam boiler electrically operable from a 120 volt electrical system including:

a first unitary U shaped member including a generally flat bridge portion and a pair of spaced apart parallel elongated leg members bent normal to said bridge portion, each of said legs forming complementary specific end shapes, said bridge and legs being of a generally corresponding thickness and width;

a second unitary U shaped member including an elongated bottom bridge portion having a cross sectional shape complementary with the specific shape of said leg ends of said first unitary U shaped member, a pair of spaced apart parallel wall leg members projecting from said bottom bridge of a length corresponding to the length of said bottom bridge portion of a height generally corresponding to the height of said legs of said first unitary U shaped member, said bottom bridge and legs of a generally corresponding thickness less than the thickness of said first unitary U shaped member and of a corresponding length of said first unitary U shaped member;

said first and second unitary U shaped members interfitted one within the other whereby the legs of said first unitary U shaped member form the ends of said boiler, said generally flat bridge portion of said first U shaped member forms the top of said boiler, said bottom bridge portion of said second U shaped member forms the bottom of said boiler and said parallel wall legs form the side walls of said boiler, and a water and steam chamber formed within said interfitted first and second U shaped members;

a heater element operating on or about 1000 watts mounted within said water and steam chamber and having electrical leads passing from said heater outward of one of said ends;

a visual translucent water gauge on one of said ends communicating with said chamber whereby the level of water therein may be observed;

a steam solenoid valve mounted on top of said boiler communicating with said chamber adapted to regulate the volume of steam being emitted from said boiler;

electrical resistance probe means mounted on top of said boiler and extending into said chamber adapted to sense the level of water therein and regulate the flow of water into said chamber;

a water outlet through the bottom of said boiler communicating with said chamber;

a pump means to move the water from an external water source into said chamber;

a steam iron having a heating element therein associated with said boiler through a steam hose that may be activated by 120 volt electrical energy; and said boiler and steam iron together operate on about 15 amps, and the energy to operate said boiler and iron is a single 120 volt electrical receptacle.

* * * * *